United States Patent [19]

Puppel

[11] Patent Number: 4,662,189

[45] Date of Patent: May 5, 1987

[54] SUPPORTING STRUCTURE FOR AIR CONDITIONER APPARATUS HAVING AN INDOOR AND AN OUTDOOR UNIT

[76] Inventor: Richard A. Puppel, 280 Croswell Rd., Columbus, Ohio 43214

[21] Appl. No.: 661,132

[22] Filed: Oct. 15, 1984

[51] Int. Cl.[4] ..... F16D 31/02

[52] U.S. Cl. ..... 62/449; 62/259.1

[58] Field of Search ..... 98/94.2; 62/261, 263, 62/259.1, 329, 448, 449, 457

[56] References Cited

U.S. PATENT DOCUMENTS

| | | | |
|---|---|---|---|
| 2,335,627 | 11/1943 | Wolfert | 62/448 |
| 3,257,933 | 6/1966 | Baylinson | 98/94.2 |
| 4,019,339 | 4/1977 | Anderson | 62/449 |

*Primary Examiner*—Henry Bennett

*Attorney, Agent, or Firm*—Anthony D. Cennamo

[57] ABSTRACT

A movable apparatus for an air conditioner having an indoor unit and an outdoor unit. The movable unit comprises a rigid platform having movable means. Said indoor unit and said outdoor unit positioned fore and aft on said platform. An intermediate area of said platform of a height just slightly above ground, and without interfering obstrusions therefrom. Service lines, interconnecting said outdoor unit to said indoor unit crossing said intermediate area having a negligible vertical dimension. A movable indoor/outdoor wall or door upstanding from said intermediate area separating said indoor unit from said outdoor unit. The air conditioner may comprise either cooling units or heating units having an indoor and an outdoor unit.

11 Claims, 6 Drawing Figures

SUPPORTING STRUCTURE FOR AIR CONDITIONER APPARATUS HAVING AN INDOOR AND AN OUTDOOR UNIT

BACKGROUND

There has been in recent years a substantial rise in the number of new businesses in light manufacturing or the like. These businesses may comprise relatively few employees up to the order of one hundred.

To accomodate this type of business, the construction industry have built a substantial number of units of an appropriate size. Characteristically, these units will comprise a front office area and a huge open space with high ceilings. Equally characteristic is that the open space will have at one end, or perhaps at both ends, an oversize overhead door.

In most of these units there is no air-conditioning apparatus for cooling of the area; and in some there may be no apparatus for heating of the area. In those instances the tenants have no alternative except to install appropriate air conditioning apparatus.

The occupancy expectancy of the tenants of this type of structure is very short. They either go out of business or if successful, expand beyond the facilities occupied.

A tenant is confronted with installing a unit of many thousands of dollars and at a sizeable installation cost. However, if the tenant vacates the premises he has lost his investment cost; the air conditioner has become a permanent part of the real estate and legally cannot be moved. Alternatively, if the air conditioner could be removed from the premises, the cost of removal would approach the value of the apparatus. In either instance, the tenant has lost his investment.

SUMMARY OF INVENTION

The present invention in its preferred embodiment comprises a commercial indoor/outdoor unit air conditioner, modified in its supporting structure to be utilized without permanent installation, and hence, does not become a part of the realty.

The overall apparatus is of a size that normally would require permanent installation that would become a permanent part of the realty. The operation and the function of the air conditioner is untouched.

The primary basis for the modification to the supporting structure, i.e. not the air conditioner per se, is to roll the unit to an area such as with an overhead door and position the unit relative to the overhead door so the plenum unit is indoors but the compressor/condensor unit is outdoors. If with an overhead door, the door is closed in its normal manner, but yet, the function between the indoor/outdoor units is also uninhibited.

The supporting structure comprises a modified platform having at least four sets of wheels. The platform has an intermediate area positioned just slightly above ground level. The service lines crossing the intermediate level are reduced in diameter in the vertical and increased in diameter in the horizontal. No upright structure interferes with the intermediate area.

An overhead door or other type of wall has its lowermost end in contact with said intermediate area, and seperates said indoor unit from said outdoor unit. The type of wall may comprise a temporary wall or the typical and standard overhead door.

OBJECTS

It is accordingly a principal object of the present invention to modify the supporting structure for an indoor/outdoor unit air conditioner to render it mobile.

Another object of the present invention is to provide an undercarraige for an indoor/outdoor unit air conditioner that is a substitute for permanent installation.

A further object of the present invention is to provide an undercarraige for an indoor/outdoor unit air conditioner that is operable without tampering with or altering the building and again without modifying either the indoor or outdoor unit.

Other objects and features of the present invention will become apparent from the following detailed description when taken in conjunction with the drawings in which:

DETAILED DESCRIPTION OF DRAWINGS

Figure 1:
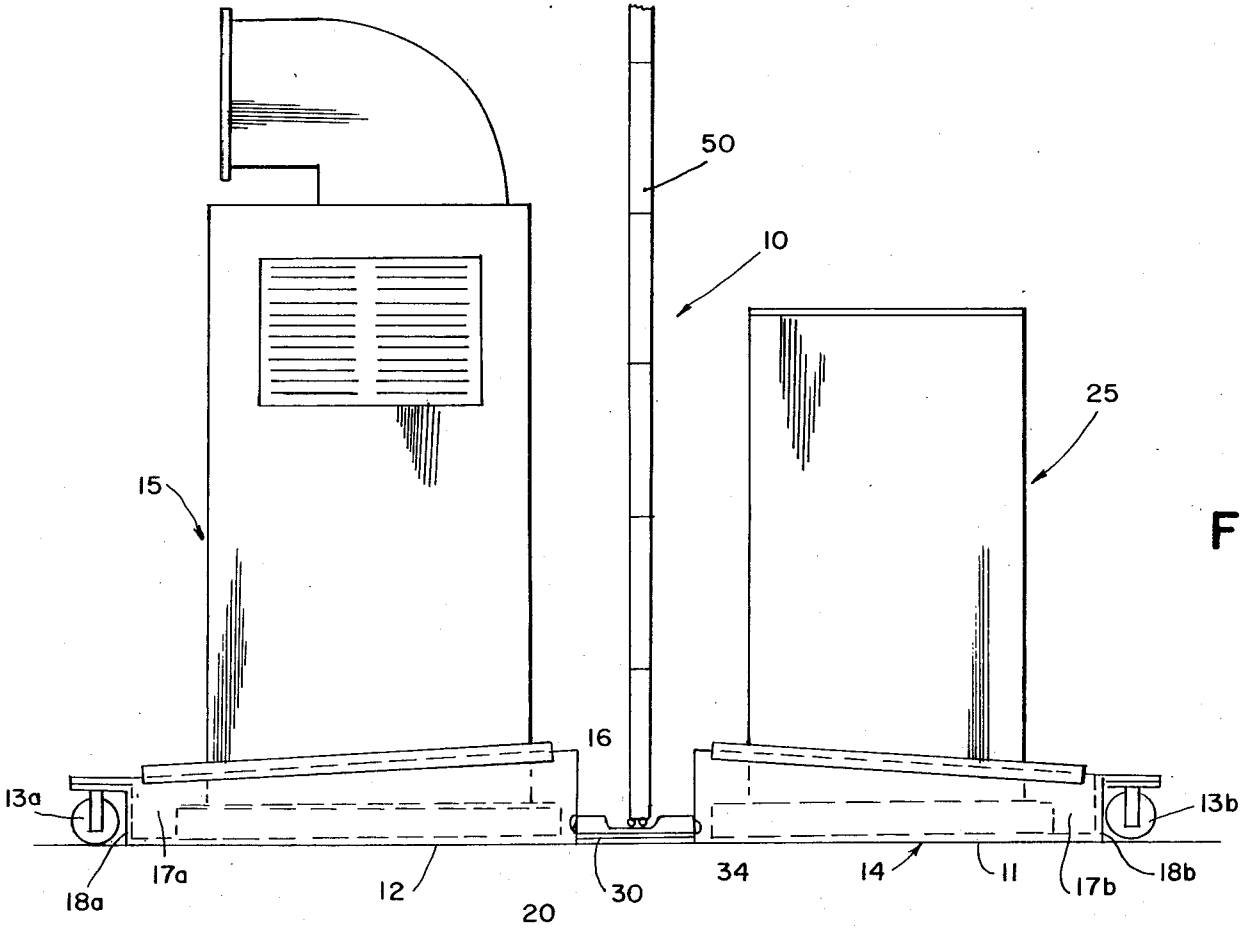
FIG. 1 is an overall view of the indoor/outdoor unit air conditioner together with the mobile base of the present invention.

With specific reference now to the drawings and particularly FIG. 1, there is illustrated a commerical type of air conditioner having a supporting base constructed in accordance with the preferred embodiment of the present invention to permit the use thereof without permanent installation.

The indoor unit 15 comprises the plenum, controls, and other operable apparatus. The outdoor unit 25 is generally that of the compressor/condenser. Interconnecting the unit 15 and the outdoor unit 25 are service lines. The service lines in addition to electrical cables, comprises the freon lines 30, from expanded line 34.

The supporting structure for the air-conditioner is a single unit divided into fore half 12 and aft half 14 by the intermediate area 16.

The supporting unit comprises a platform or base member 11. Upstanding from the base member 11 are walls 17*a* and 17*b* (17*c* and 17*d* are on opposite sides). On the two extreme ends, walls 18*a* and 18*b* join with the aforesaid side walls.

Mounted, by bracket or other very rigid means, are wheels 13*a*, 13*b*, 13*c*, and 13*d* having an overall height just slightly greater than that of the end walls 18.

It can be appreciated, the overall supporting structure 10 provides a recessed area with the platform 11 just above the ground. The wheels on the overall supporting structure 10 provide movability.

Figure 2:
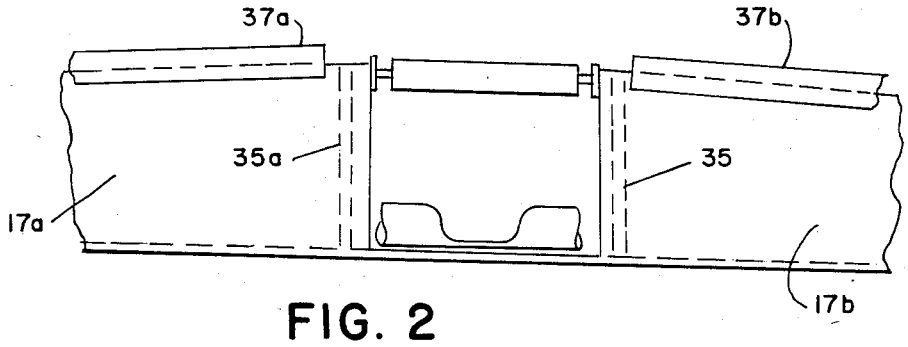
FIG. 2 is an exploded view of the base 1.
Figure 3:
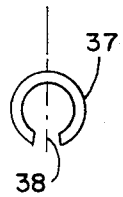
FIG. 3 illustrates an end view and FIG. 3A a side view of the rigid structure utilized in FIG. 1.
Figure 3A:
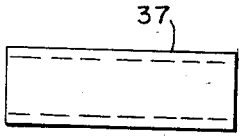

Referring now to FIG. 2, the upstanding side wall members 17 *a, b, c,* and *d* are of relatively small thickness; and when coupled with the removal of the wall at the aforesaid intermediate area 16, the side walls 32 *a, b, c,* and *d* will have a tendency to warp and buckle. In such a condition movability is restricted. To add rigidity to the side walls 32 *a, b, c,* and *d,* there are positioned right angle braces 35 *a, b, c,* and *d* adjacent the inside ends thereof at the intermediate area. Further elongated members 37 *a, b, c,* and *d,* are placed over the edge of each side wall 17 *a, b, c,* and *d.* These elongated members 37 *a, b, c,* and *d* as shown in FIGS. 3 and 3A, comprise metallic tubes 37 with a longitudinal slot 38 formed therein.

The service lines interconnecting the indoor unit 15 to the outdoor unit 25 primarily comprise the freon lines; the hot freon line 32 and the expanded freon line 34. These lines conventionally are copper lines and relatively large in diameter. In an air-conditioning unit as aforesaid the expanded line 34 will be in the order of two inches.

Figure 4A:
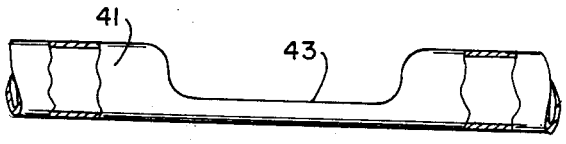
FIG. 4 is an a frontal view and FIG. 4A a side view of alternative construction of the primary service line.
Figure 4:
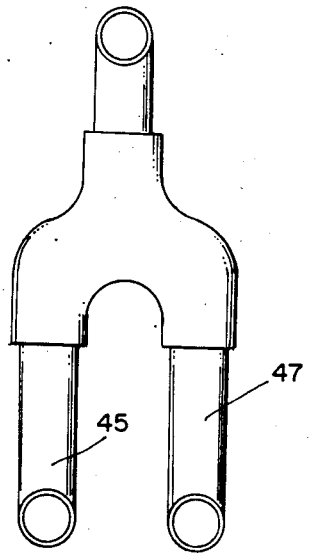

For the intended purpose of the preferred embodiment of the invention, a two inch rise above the floor, perhaps even one inch or less, would be unsatisfactory for the intended purpose. Accordingly, in accordance with the concepts herein with reference to FIGS. 4 and 4A the copper line 41 was reduced in its vertical height at its center area 43 to the order of three/eights of an inch by placing the line 41 under force pressure. The reduction in cross-sectional area in turn reduces the flow in the order of fifty percent. To restore the flow to its full capacity, a pair of lines 46 and 47 as shown in FIG. 4 were used in lieu of the single line. The two lines 45 and 47 terminate in a Y connector 48 at the indoor unit 15 side of the intermediate area 16 and in a Y connector 49 at the outdoor unit 25 side of the intermediate area 16. It is to be appreciated that single line of double size alternatively may be used; or manfolding several small lines.

Returning now to FIG. 1, the concepts of the invention of the preferred embodiment are illustrated in actual useage.

Upstanding intermediate the indoor unit 15 and the outdoor unit 25, shown in an end view, is a door or wall 50.

As aforesaid, the primary object of the present invention is to obviate permanet installation in many and specific types of buildings that provide a substantial access to the outside i.e. a large overhead opening door.

Accordingly, the air conditioner 10, when complete with the supporting structure 20 of the present invention, is "moved" to the outside wall area and beneath the open overhead door 50. When aligned in space, the overhead door is pulled down to it's normally closed or shut position as shown. The door 50 intersects the intermediate area 16 at its lowermost end. The underside of the lowermost end of the door 50 rests on the reduced section 43 (FIG. 4A). The space difference between the door 50 in its naturally closed position and that shown is negligble to air control.

It is understood the term air conditioner encompasses all forms of envirnmental control including heating, cooling, and in some instances humidification or dehumidification; so long as the requirement of having an indoor unit and an outdoor unit is met.

The reduced diameter service line provides the necessary function; but yet permits the overhead door to close normally. Other forms of reduced or modified service lines may be utilized; one such line would be to employ several much smaller diameter lines in parrallel in a horizontal plane. However, in any form the intermediate area 16, to permit natural closing of the door 50, with the modified service lines 41, will remain as shown.

Although specific and certain configurations are illustrated it is to be understood that modifications, alternatives, and departures thereto may be had without departing from the spirit and scope of the invention.

I claim:

1. A movable air conditioner movable over a floor joining an indoor and an outdoor area and of the type normally having an indoor unit positioned indoors and an outdoor unit positioned outdoors, comprising:

a platform having movable means associated therewith, means for positioning the indoor unit on one end of said platform, said platform further having an intermediate area between said indoor and outdoor units, free of interfering obtrusions and positioned just slightly above said floor, service lines interconnecting said indoor unit and said outdoor unit for operation thereof, crossing said intermediate area of said platform, said service lines comprising a plurality of lines connected in parallel planar relationship to said platform at the lowermost region of said intermediate area, said intermediate area of sufficient depth to permit a utility wall to be positioned between said indoor unit and said outdoor unit and thereby separate said indoor unit from said outdoor unit, said vertical dimension of said intermediate area with said lines crossing sufficiently small to permit substantially normal positioning of said utility wall relative to said floor.

2. The movable air conditioner of claim 1 wherein said utility wall between said indoor and outdoor unit is an overhead door.

3. The movable air conditioner of claim 1 wherein said plurality of parallel lines in connecting said indoor unit to said outdoor unit and crossing said intermediate area, comprises a Y connector fore of said intermediate are and connected to each of said plurality of lines, and the opposite ends of said plurality of lines connected to another Y connector aft of said intermediate area.

4. The movable air conditioner of claim 1 wherein said intermediate wall further comprises vertical walls having a portion thereof removed at said intermediate area, and rigid members to provide rigidity to said upstanding members.

5. The movable air conditioner of claim 4 further comprises a rigid means for insertion between said vertical walls, to add overall rigidity to said supporting structure upon moving.

6. The movable air conditioner of claim 4 further comprising longitudinal rigid means positioned on the upper edge of said upstanding side walls to provide rigidity over the length thereof.

7. The air conditioner of claim 6 wherein said longitudinal rigid means comprises a rod having a longitudinal slot formed therein.

8. The air conditioner of claim 3 wherein said pair of lines between said fore Y connector and said aft Y connector have a reduced vertical dimension.

9. The air conditioner of claim 1 wherein said movable means is a set of four wheels.

10. The air conditioner of claim 3 wherein said interconnecting service lines comprise a plurality of lines, each of said plurality of lines have a diameter substantially less than the leg of said Y connectors and wherein said plurality of lines are connected respectively to said Y interconnecting connectors in a parallel planar relationship to said platform.

11. The air conditioner of claim 1 wherein said movable means is a pallet.

* * * * *